United States Patent [19]

Kudlacek

[11] Patent Number: 4,535,747

[45] Date of Patent: Aug. 20, 1985

[54] BOWSIGHT FOR COMPOUND ARCHERY BOWS

[76] Inventor: Donald S. Kudlacek, 3412 Oak St., Longview, Wash. 98632

[21] Appl. No.: 476,057

[22] Filed: Mar. 17, 1983

[51] Int. Cl.[3] ..... F41B 5/00

[52] U.S. Cl. ..... 124/87; 33/265

[58] Field of Search ..... 124/87, 23 R, 24 R, 124/88; 33/265

[56] References Cited

U.S. PATENT DOCUMENTS

| | | | |
|---|---|---|---|
| 4,026,032 | 5/1977 | Smith | 33/265 |
| 4,136,462 | 1/1979 | Topel | 33/265 |
| 4,170,071 | 10/1979 | Mann et al. | 124/87 X |
| 4,305,208 | 12/1981 | Larson | 33/265 |

*Primary Examiner*—Richard J. Apley

*Assistant Examiner*—William R. Browne

*Attorney, Agent, or Firm*—Oliver D. Olson

[57] ABSTRACT

The archery bowsight includes a base plate arranged for removable attachment to the handle portion of a bow and supporting a longitudinally extendable mounting arm which mounts at its forward end a horizontally adjustable bowsight windage carriage which, in turn, mounts an elevation carriage provided for micrometrically graduated vertical movement perpendicular to the plane of movement of the aforesaid windage carriage. An elongated sight pin mounting block mounts a plurality of sighting pins for individual adjustment parallel and perpendicular to the longitudinal dimension of the block in order to provide yardage and elevation adjustment of each pin for sighting on targets of various distances while also providing for horizontal adjustment of each pin for various windage conditions.

14 Claims, 6 Drawing Figures

BOWSIGHT FOR COMPOUND ARCHERY BOWS

BACKGROUND OF THE INVENTION

This invention relates to sights for archery bows, and more particularly to a multiple sight pin archery bowsight for use in both tournament shooting and bow hunting.

Multiple pin-type sighting devices for archery bows are known in the art, and fall into two basic categories: Sights utilizing a plurality of sight pins arranged in a single longitudinally extending adjustment slot in a mounting plate, and sights utilizing a plurality of sight pins arranged in a pair of parallel longitudinally extending adjustment slots in a mounting plate.

In the first case, the sight pins are arranged to extend through the single adjustment slot, whereupon the sight pins are disposed in a single plane. However, such configurations severely restrict the adjustment of adjacent pins in that the pins cannot be moved close enough together to allow for fine settings of relatively small changes in yardages.

In the second case, the plurality of pins are arranged to extend through a pair of parallel-extending slots. However, such a configuration provides sighting pins arranged in two rows each at a different distance from the eye of the archer. In this respect, while closer adjustment of adjacent pins may be made, the varying distance of each adjacent pin from the archer's eye reduces the accuracy of fine aiming on a target.

Also, in both categories of pin-type bowsights described above, no provision for individual adjustment of each sight pin for windage conditions and differing shooting characteristics is made. While gross adjustment of the entire bank of sight pins jointly may be made with some sights of the prior art, the constructions of the prior art bowsights do not afford each individual sighting pin separate adjustment perpendicular to the plane of its supporting slot.

Additionally, because the sight pins on a hunter's bow are very susceptible to breakage during movement through underbrush and foliage common in hunting grounds, some hunter bowsights of the pin type include fixed protective frames overlying the sight pins. A crosshair sighting wire also is often provided to increase the ease of sighting on a target. However, because of regulations in tournament shooting, which ban the use of framework around the sighting pins and the use of crosshair devices, such hunting sights are not acceptable for competition use. Accordingly, for target shooting the hunting sight must be replaced with a sight that does not utilize a pin-protecting frame and crosshair.

SUMMARY OF THE INVENTION

In its basic concept, this invention provides an archery bowsight in which a plurality of sight pins are mounted by means of at least one vertical guide slot for independent adjustment of each pin in directions extending both parallel to and perpendicular to said guide slot.

It is by virtue of the foregoing basic concept that the principle objective of this invention is achieved; namely, to overcome the disadvantages and limitations of archery bowsights of the prior art.

Another object of this invention is the provision of an archery bowsight of the class described which includes mechanism for fine adjustment of the pins, both individually and jointly, for windage, yardage and elevation.

Another object of this invention is the provision of an archery bowsight of the class described in which the sight pins may be individually adjusted into vertically aligned positions for accurate sighting on a target even when an archer's aiming habits involve the holding of the bow in a tilted, non-vertically extending position.

Another object of this invention is the provision of an archery bowsight of the class described in which interchangable, preset sight-pin-supporting modules may be quickly and easily mounted for rapid and accurate sighting for various shooting needs.

Yet another object of this invention is the provision of an archery bowsight of the class described which is arranged with parts that are easily reversible in order that the sight may be arranged for use by either a right or left handed archer.

A further object of this invention is the provision of an archery bowsight of the class described which may mount a removable pin guard frame arranged to protect the sight pins from damage and may also mount an adjustable crosshair sight wire for use in bow hunting.

A still further object of this invention is the provision of an archery bowsight of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 2:
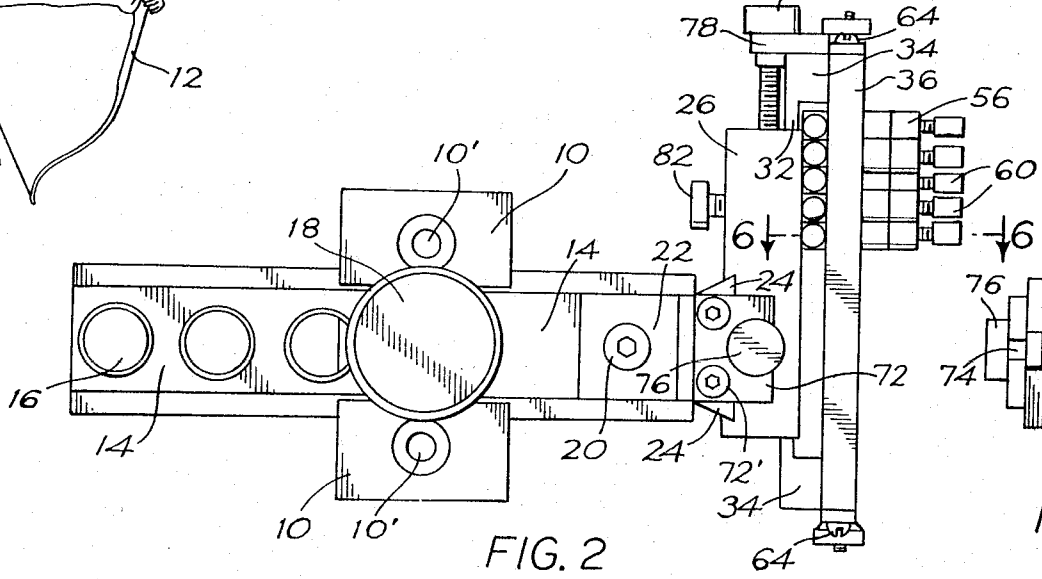
FIG. 2 is a side elevation of the archery bowsight of FIG. 1.
Figure 6:
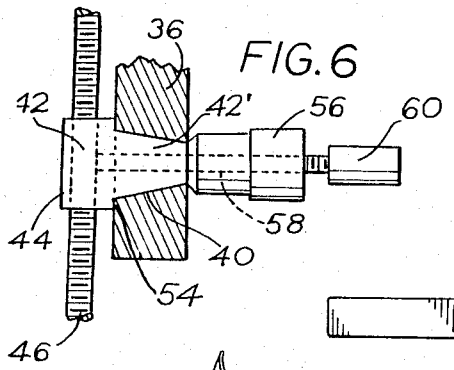
FIG. 6 is a fragmentary section taken along the line 6—6 in FIG. 2, illustrating the structural arrangement of a sighting pin and its mounting assembly.
Figure 1:
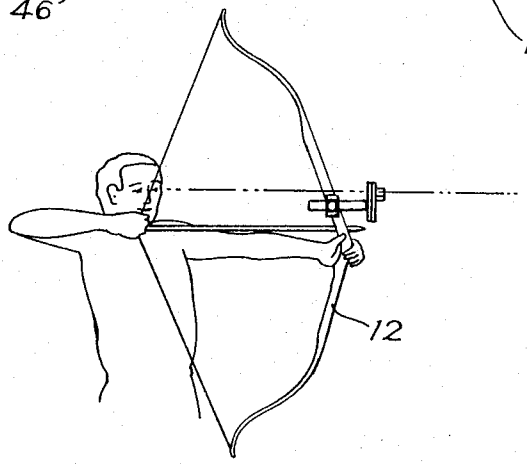
FIG. 1 is a schemetic diagram of an archery bow in full draw position and mounting a bowsight embodying the features of this invention.

The bowsight of this invention includes a bow handle mounting plate 10 arranged to be anchored as by screws (not shown) through bores 10' to a desired position on a bow handle 12. As illustrated in FIG. 2, the mounting plate 10 includes a centrally located dovetail slot arranged to slidably receive an elongated mounting arm 14 having a corresponding dovetail cross section.

Figure 5:
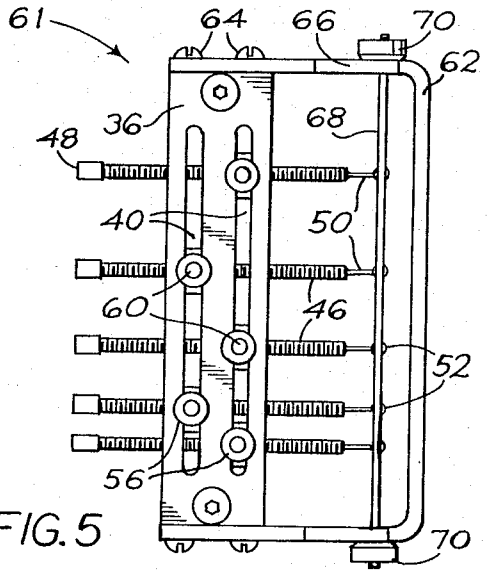
FIG. 5 is a front elevation of the sight-mounting module component of the bowsight with the plurality of sighting pins pre-adjusted to positions different from the positions shown in FIG. 4.
Figure 4:
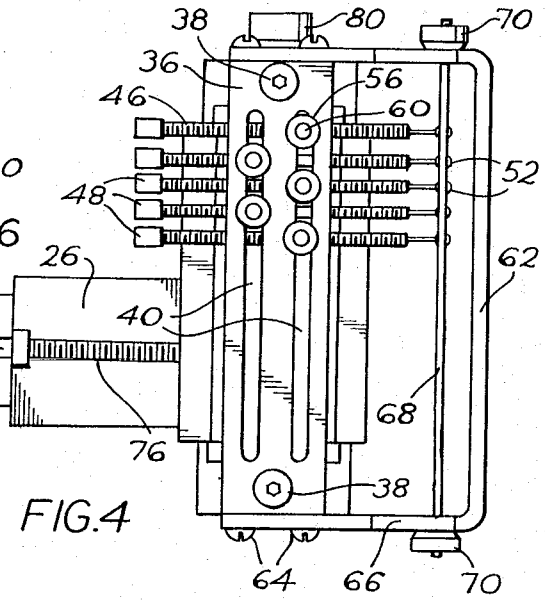
FIG. 4 is a front elevation of the bow sight of FIG. 2.
Figure 3:
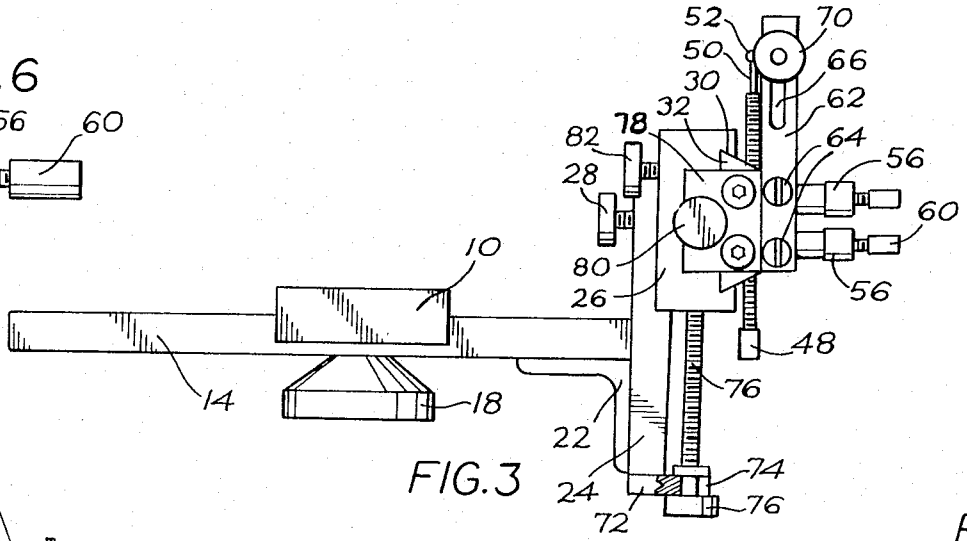
FIG. 3 is a plan view of the bowsight shown in FIG. 2.

The arm 14 includes a plurality of longitudinally spaced, threaded bores 16 which, in cooperation with a set screw 18, provide means for releasably securing the arm 14 to the plate 10 in various positions in longitudinal extension. The forward end of the arm 14 mounts, as by screw 20 or other suitable means, a support bracket 22 configured to mount an elongated carriage guide arm 24 perpendicular to the plane of the mounting arm 14, as shown in FIG. 3.

The carriage guide arm 24 may be configured with a dovetail cross section, as illustrated, for cooperation ously described is as follows: Adjustment of yardage, elevation, and windage settings of the sight pins 46 is first done through a series of shootings at targets of various known distances. The individual yardage settings of the sighting pins may be adjusted by loosening the locking knobs 56 one at a time and sliding the associated sighting pin up or down in the slot 40 while making practice firings at targets until the respective pin is set at the appropriate yardage position, whereupon the knob 56 is retightened. Other pins are then adjusted in similar fashion until all desired yardage pin settings have been preset.

While making the above practice shootings, it may be necessary to compensate for various windage conditions, aiming habits and bow characteristics for which horizontal adjustment of the sight pins may be required. This is accomplished by loosening the set screw 60 and turning the sighting pin 46 in or out, thus moving the sighting ball 52 right or left relative to a given preliminary position, and then retightening the set screw 60 when a desired pin position has been found.

In the event that, for various shooting purposes and for various shooting distances and settings, more than one pre-set sighting module assembly 61 is desired for rapid installation and use, the above yardage and windage adjustment procedures may be repeated upon removing the pre-set sighting module and installing a different module and adjusting the latter as above. In this respect, a wide variety of interchangable, pre-set modules may be provided for rapid replacement onto the carriage 32 for shooting at a wide variety of targets.

Once the sight pins 46 on a module have been individually adjusted, adjustment for elevation and windage can be made of the entire set of sight pins jointly. Adjustment for elevation is accomplished by loosening the set screw 82 and turning the micrometer screw 80 threaded into the carriage 26 so as to move the elevation carriage 32 up or down. Moving the carriage downwardly causes the archer to aim the bow higher in order to align the desired sighting pin with the target, thereby allowing for a greater elevation in the projected arrow's flight, and thus a greater target distance. Conversely, moving the carriage 32 upwardly allows for less elevation of the projected arrow for use with targets of closer distances. Once the desired elevational setting is obtained in this manner, the carriage locking set screw 82 is retightened, thus preventing undesirable movement of the carriage.

Joint adjustment of the sight pins 46 for horizontal, windage conditions is obtained by loosening set screw 28 and turning the micrometer screw 76 to move the windage carriage 26 left or right. Moving the carriage to the left causes the archer to move the bow to the right in order to sight on the target, thus allowing for a right-to-left crosswind between the archer and the intended target. Conversely, moving the carriage 26 to the right would similarly compensate for a left-to-right crosswind.

The two adjustments for windage thus provided, both individual pin adjustment and adjustment of the pin-mounting carriage itself, affords a greater benefit to a bowsight particularly in that as target distances increases, so increases wind influence on a projected arrow the longer it is in flight. Thus, while windage might affect the flight of an arrow only slightly at short distances, the same wind conditions may greatly affect the flight of the arrow at longer distance. Therefore, the provision of the desired individual adjustment of each pin set at various respective distances and joint adjustment of all pins together increases the efficiency of the bowsight considerably.

For storage, transportation and hunting, the pin protector frame 62 may be installed on a desired module as discussed earlier, with or without the crosshair wire 68, in order to guard against unintentional damage of the sighting pins. When mounted to the frame 62, the crosshair wire 68 may be adjusted laterally along the length of the slots 66 on the frame so that the wire may be aligned with the sight balls 52 on the pins to facilitate proper aim. In tournament shooting however, the protector frame 52 and the crosshair 68 are not permitted because of official regulations. Accordingly, the frame must be removed from the module being used or a different module not mounting a frame and crosshair would be mounted to the carriage 32 during tournament play.

For use of the bowsight by a left-handed archer, the bowsight would be mounted on the opposite side of the bow handle, the carriage 26 is simply inverted on its guide 24, and the sighting module is rotated 180° on its mount to the carriage 32. The protector frame and crosshair wire, if attached, do not have to be remounted to the module.

This bowsight is arranged to accommodate accurate aiming on targets by archers that habitually hold a bow in a tilted position, i.e. extending obliquely relative to the ground. In such event the sight pins may be adjusted so that the sight balls 52 of the pins are aligned in a vertical plane even though the bow is held in the tilted position.

Moreover, with the crosshair wire being mounted adjustably to the frame 62, as illustrated, each terminal end of the wire may be moved in the slot 66 toward or away from the module so as to align the wire with the sight balls 52.

It will be apparent to those skilled in the art that various changes other then those previously described may be made in the size, shape, type, number and arrangement of parts described hereinbefore without departing from the spirit of this invention and the scope of the appended claims.

Having now described my invention and the manner in which it may be used, I claim:

1. An archery bowsight, comprising:

(a) a base configured for mounting to the handle member of an archery bow, (b) a windage carriage mounted on the base for horizontal movement relative thereto, (c) an elevation carriage mounted on the windage carriage for vertical movement relative thereto, (d) a sight pin mounting block mounted on the elevation carriage for movement therewith, (e) a plurality of elongated sight pins, (f) a plurality of sight pin mounting members each mounting a different one of the sight pins for longitudinal adjustment relative to its associated mounting member, and (g) an elongated pin mount support on the sight pin mounting block for supporting the sight pin mounting members for adjustment therealong with the elongated sight pins mounted on the sight pin mounting members for longitudinal adjustment in the direction perpendicular to the pin mount support.

2. The archery bowsight of claim 1 wherein the sight pin mounting block has a pair of parallel elongated pin